United States Patent [19]

Bowman

[11] Patent Number: 4,833,458

[45] Date of Patent: May 23, 1989

[54] SMOKE AND FIRE DETECTOR FOR REMOTE SENSING

[76] Inventor: Gerald E. Bowman, Rte. #2, Box 2328A, Lewiston, Mich. 49756

[21] Appl. No.: 231,602

[22] Filed: Aug. 11, 1988

Related U.S. Application Data

[63] Continuation of Ser. No. 64,756, Jun. 22, 1987, abandoned.

[51] Int. Cl.[4] ..... G08B 17/10

[52] U.S. Cl. ..... 340/628; 340/584

[58] Field of Search ..... 340/627–630, 340/577, 584, 586, 587, 578, 579; 250/572–525

[56] References Cited

U.S. PATENT DOCUMENTS

| | | | |
|---|---|---|---|
| 3,042,907 | 11/1957 | Redway | 340/628 |
| 4,150,370 | 4/1979 | Bradshaw | 340/628 |
| 4,151,520 | 4/1979 | Full | 340/528 |
| 4,178,592 | 12/1979 | McKee | 340/628 |
| 4,315,256 | 2/1982 | Dennis | 340/584 |
| 4,319,234 | 3/1982 | Rice | 340/628 |

FOREIGN PATENT DOCUMENTS

| | | | |
|---|---|---|---|
| 2655976 | 6/1978 | Fed. Rep. of Germany | 340/628 |

*Primary Examiner*—Joseph A. Orsino
*Assistant Examiner*—Jill D. Jackson
*Attorney, Agent, or Firm*—Marshall & Melhorn

[57] ABSTRACT

A smoke and fire detector apparatus includes a base for mounting the apparatus on a wall and a tubular extension having one end attached to the base and an opposite end adapted to extend through an aperture formed in a ceiling of a room into an attic space. A sensing circuit, an audio alarm device and a power supply are mounted on the base and electrically connected to one another. A smoke sensor is mounted on the opposite end of the tubular extension and is electrically connected to the sensing circuit through the tubular extension. A second smoke sensor can be mounted on the base and electrically connected with the sensing circuit.

12 Claims, 1 Drawing Sheet

SMOKE AND FIRE DETECTOR FOR REMOTE SENSING

RELATED APPLICATIONS

This application is a continuation of application Ser. No. 064,756, filed 6/22/87, now abandoned.

BACKGROUND OF THE INVENTION

The invention generally relates to a warning device for the detection of the presence of combustion products and, more particularly, to a smoke and fire detector for installation in remote and generally inaccessible spaces.

Smoke and fire detectors are manufactured in a great variety of configurations. Many are provided with an ionization chamber or photocell for detecting combustion product particles in the air. Most of the detectors designed to be installed in a previously existing structure are powered by a battery making them portable. Thus, the detectors can be installed as required in the areas of a building where persons live and/or work.

In order to obtain maximum protection, it is necessary to install detectors at various locations in a house or commercial building. These detectors are typically mounted where they can be easily reached for checking the operation and where the warning sound can be easily heard by the occupants of the building.

Each year, many fires start in areas which are inaccessible or remote from the living or working areas of a building. For example, the attic of a home typically contains combustible materials and electrical wiring or other potential fire initiating elements. An attic fire can burn for some time before it breaks through the ceiling or walls to be sensed by a detector mounted in the living area.

U.S. Pat. No. 3,984,826 discloses a detector for detecting conditions in more than one region. The detector includes a pilot flame established by a controlled supply of fuel connected to a burner at the bottom of a vertically elongate chimney. The chimney is closed at the bottom and combustion air for the flame enters the top of the chimney and flows downwardly therein. The flame is extinguished, or diminished, when combustion products or gases other than oxygen enter the upper end of the chimney and reduce the supply of oxygen to the flame. A flame detecting device adjacent the pilot flame burner is activated in response to extinguishing, or diminishing of the flame and can be connected to cause a signal, such as an alarm, to be actuated. The detector is mounted in an enclosure and ducts lead from the enclosure to regions which are to be monitored by the detector whereby the gases from the regions influence the detector.

U.S. Pat. No. 4,319,234 discloses a smoke detector having a sensor and a power source mounted in a housing attached to one arm of a generally U-shaped downwardly directed bracket. The other arm of the bracket carries a second sensor interconnected with the first sensor and the power source whereby the bracket is adapted to be placed over the top of a door such as a hotel room door. The second sensor monitors the hallway while the first sensor monitors the interior of the room.

U.S. Pat. No. 4,481,502 discloses a central smoke detection system for a building having multiple rooms. A low cost commercial smoke detector is utilized in each room and a central power source supplies power to all the detectors via a common lead and a separate power lead to each detector.

SUMMARY OF THE INVENTION

The present invention concerns a smoke and fire detector for the sensing of combustion products in remote and/or inaccessible areas. A sensing circuit, an alarm device and a power supply are attached to a base which is adapted to be mounted on a relatively flat surface such as the wall of a room. A sensor is mounted at one end of a tubular extension having its other end attached to the housing. The sensor is connected by wiring extended through the tube to the sensing network and the tube is sealed to prevent the transfer of any combustion products from the area in which the housing is mounted to the area in which the remote sensor is located.

The present invention is particularly useful in detecting fires in locations such as attics. The housing is mounted on the wall of a room and the tubular extension is inserted through a small hole formed in the ceiling of the room to place the sensor in the attic area. A second sensor can be mounted on the housing for monitoring the room in which the housing is mounted.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
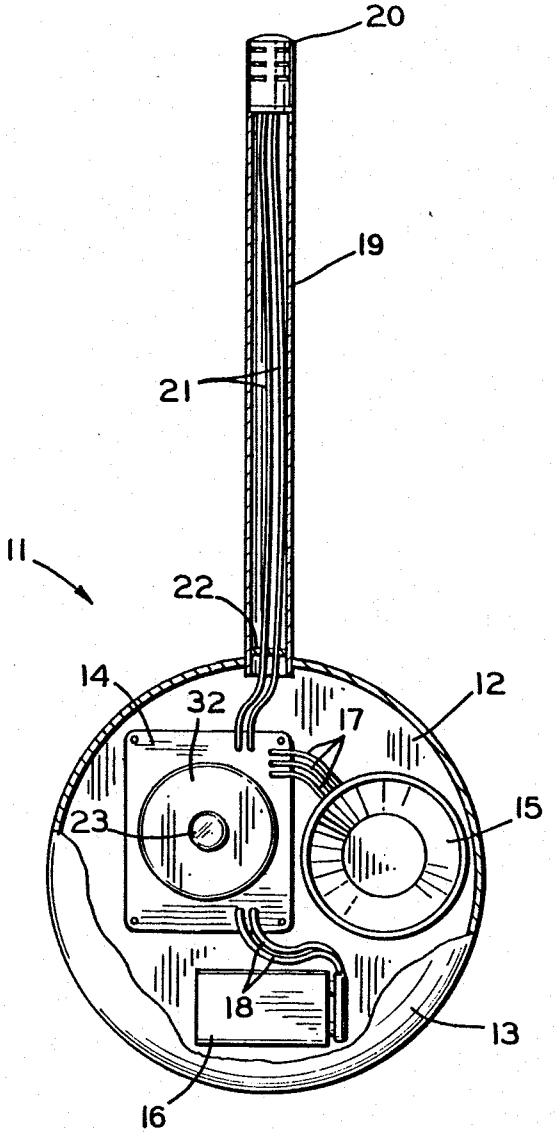
FIG. 1 is a front elevational view of a smoke and fire detector according to the present invention.

There is shown in FIG. 1 a smoke and fire detector 11 in accordance with the present invention. The detector 11 includes a housing formed of a generally cylindrical base 12 and a cup-shaped cover 13 broken away to show the internal elements of the detector 11. Mounted on the base 12 and enclosed by the cover 13 is a sensing circuit 14, an alarm horn 15 and a power supply 16 such as a battery.

The alarm horn 15 is connected to the sensing circuit 14 by a plurality of wires 17. The sensing circuit 14 includes conventional control circuitry for actuating the alarm horn 15 through the wires 17 when combustion particulate matter is sensed.

The power supply 16 is connected to the sensing circuit 14 by wires 18. The power supply 16 provides electrical power to operate the sensing circuit 14 and to operate the alarm horn 15 through the sensing circuit 14.

One end of a tubular extension 19 is attached to a side wall of the base 12. A combustion products sensor 20 is mounted on the other end of the tubular extension. The sensor 20 can be of any conventional type including the ionization chamber or a photocell. The sensor 20 is connected by wires 21 to the sensing circuit 14 to receive power from the supply 16 and to signal the circuit 14. The wires 21 extend through the tubular extension 19 and through a sealing wall 22 formed near the lower end of the tubular extension 19. The sealing wall 22 prevents particulate matter from entering the tubular extention 19 and traveling to the sensor 20 to initiate a false alarm. A test button 23 is mounted and electrically connected with the sensing circuit 14 for providing an input to test the operation of the sensing circuit 14, the alarm horn 15 and the power supply 16. The test button 23 extends through the outer surface of the cover 13 (not shown).

Figure 2:
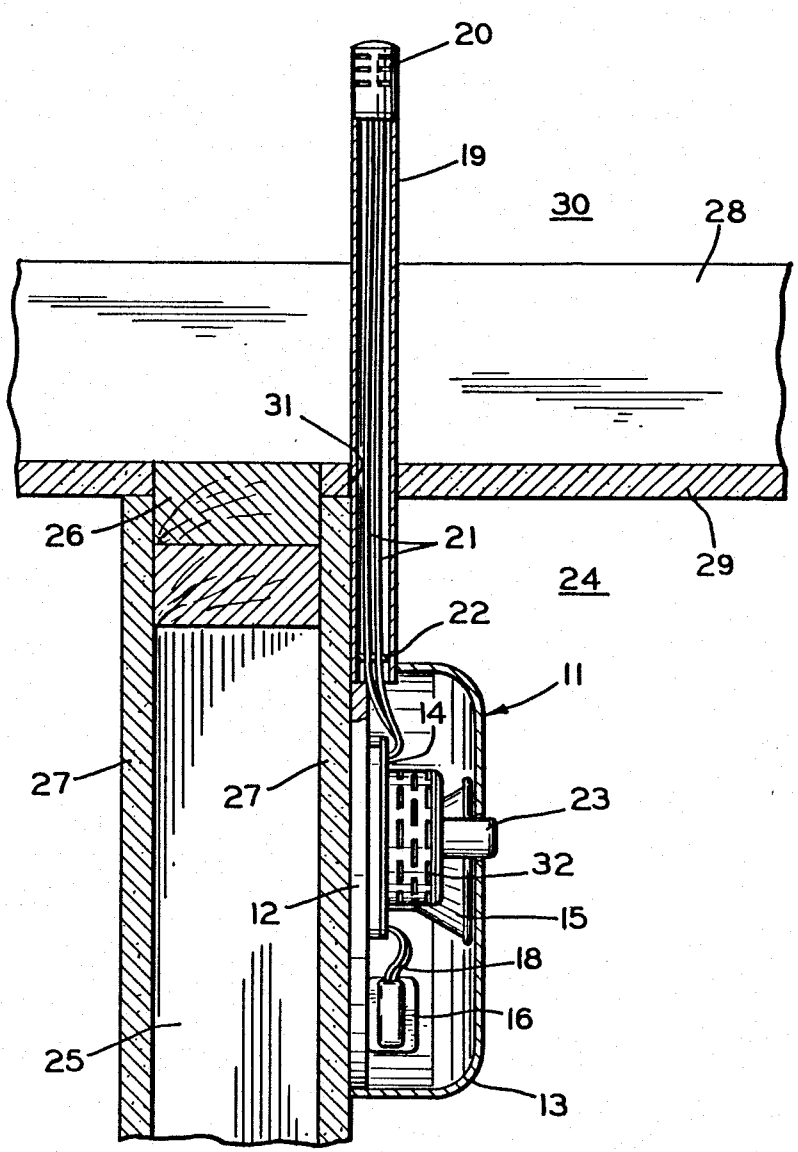
FIG. 2 is a side elevational view of the detector shown in FIG. 1 mounted for use in a building structure.

In FIG. 2, the detector 11 is shown mounted on the wall of a room. A portion of a wall and ceiling of a room 24 is shown in cross section. A wall of the room is defined by a plurality of studs 25, only one of which is shown. The upper ends of the studs are connected together by a top plate 26. The studs are covered by any conventional means such as sheets of dry wall 27 which define a vertically extending flat surface for mounting the base 12 of the detector 11. The mounting can be accomplished by any conventional means (not shown) such as threaded fasteners. The ceiling of the room 24 is defined by a plurality of rafters 28, only one of which is shown, which rest on top of and are connected to the top plate 26. The spaces between the rafters can be filled with insulation (not shown). The rafters can be covered by any suitable means such as dry wall 29 to form the ceiling of the room 24.

The dry wall 29 separates the room 24 from a space above the ceiling which is typically known as an attic space 30. The attic space 30 is relatively remote and inaccessible from the room 24. Thus, any conventional smoke and fire detector mounted in the room 24 would not detect a fire which started in the attic space 30 until such a fire was well under way and could break through the dry wall 29. The present invention provides an early warning for attic fires by locating the sensor 20 in the attic space 30. Prior to installing the detector 11 on the surface of the dry wall 27, a relatively small aperture or hole 31 is formed in the dry wall 29 adjacent the junction of the dry wall 27 and the dry wall 29. The extension 19 is approximately the same diameter as the aperture 31 and the sensor 20 has a diameter no greater than the diameter of the extension to enable the extension and the sensor to pass through the aperture 31. The sensor 20 and the tubular extension 19 are then inserted through the aperture 31 to extend the sensor 20 into the attic space 30. The base 12 is mounted on the dry wall 27. The sensing circuit 14 can also include a second sensor 32 for sensing particulate matter in the room 24 such that the sensing circuit 14 responds to either of the sensors for sounding an alarm.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a smoke and fire detector apparatus having a housing, a sensing circuit mounted in the housing, an electric power source mounted in the housing and connected to the sensing circuit, and an alarm signalling device mounted in the housing and connected to the sensing circuit, the improvement comprising:

a tubular extension having one end attached to the housing and an opposite end adapted to extend through a wall into an enclosed space;

means for sensing combustion products in the enclosed space remote from a space occupied by the sensing circuit including a smoke and fire sensor mounted on said opposite end of said tubular extension and electrically connected to the sensing circuit; and means for sealing said tubular extension against a flow of gas between said one end and said opposite end.

2. The apparatus according to claim 1 wherein said means for sealing is a wall formed inside said tubular extension.

3. The apparatus according to claim 1 including another sensor mounted on the housing and electrically connected to the sensing circuit.

4. A smoke and fire detector apparatus, comprising:

a housing adapted to be mounted on a wall in a room;

a sensing circuit mounted on said housing;

an electric power source mounted on said housing and electrically connected to said sensing circuit;

a hollow extension having one end attached to said housing and an opposite end adapted to extend through an aperture formed in a ceiling of the room, said extension having a diameter approximately the same as the diameter of the aperture;

a smoke and fire sensor mounted on said opposite end of said extension and electrically connected to said sensing circuit for sensing combustion products in a space remote from the room, said sensor having a diameter no greater than the diameter of said extension; and means for internally sealing said extension against a flow of gas between said one end and said opposite end.

5. The apparatus according to claim 4 including another smoke and fire sensor mounted on said housing and electrically connected to said sensing circuit.

6. The apparatus according to claim 4 wherein said electric power source is a battery.

7. The apparatus according to claim 4 wherein said extension is tubular in cross section.

8. The apparatus according to claim 4 wherein said means for sealing is a wall formed inside said extension.

9. The apparatus according to claim 4 including wire means electrically connecting said smoke and fire sensor to said sensing circuit, said wire means extending through said extension and said means for sealing.

10. The apparatus according to claim 4 including an audio alarm signalling device electrically connected to said sensing circuit and responsive to a signal generated by said smoke and fire sensor for sounding an alarm.

11. The apparatus according to claim 10 wherein said alarm signalling device is mounted on said housing.

12. A smoke and fire detector and alarm apparatus for detecting combustion products in a remote location, comprising:

a base adapted to be mounted on a generally vertically extending wall in a room;

a sensing circuit mounted on said base;

an electric power source mounted on said base and electrically connected to said sensing circuit;

one smoke sensor mounted on said base and electrically connected to said sensing circuit;

an audio alarm signalling device mounted on said base and electrically connected to said sensing circuit;

a tubular extension extending in a generally vertical direction and having one end attached to said base and an opposite end adapted to extend through an aperture formed in a ceiling of the room and into an attic space remote from the room, said extension having approximately the same diameter as the aperture;

another smoke sensor mounted on said opposite end of said tubular extension and electrically connected to said sensing circuit for sensing combustion products in the attic space, said another smoke sensor having a diameter no greater than the diameter of said extension; and a wall formed inside said tubular extension for sealing said tubular extension against a flow of gas internally between said one end and said opposite end.

* * * * *